United States Patent [19]

Jamet et al.

[11] Patent Number: 5,062,804

[45] Date of Patent: Nov. 5, 1991

[54] METAL HOUSING FOR AN ELECTRICAL CONNECTOR

[75] Inventors: Daniel Jamet, Nozay; Christian Guiberteau, Longjumeau, both of France

[73] Assignee: ALCATEL CIT, Paris, France

[21] Appl. No.: 617,841

[22] Filed: Nov. 23, 1990

[30] Foreign Application Priority Data

Nov. 24, 1989 [FR] France ..... 89 15481

[51] Int. Cl.[5] ..... H01R 4/24

[52] U.S. Cl. ..... 439/394; 439/578

[58] Field of Search ..... 439/289–425, 439/578–585, 607–610

[56] References Cited

U.S. PATENT DOCUMENTS

| | | | |
|---|---|---|---|
| 2,694,182 | 11/1954 | Elden et al. | 439/394 |
| 4,416,501 | 11/1983 | Fusselman et al. | 439/394 |
| 4,708,414 | 11/1987 | Lam | 439/394 |
| 4,758,179 | 7/1988 | Klein et al. | 439/497 |

FOREIGN PATENT DOCUMENTS

| | | |
|---|---|---|
| 0187255 | 7/1986 | European Pat. Off. . |
| 0228750 | 7/1987 | European Pat. Off. . |

*Primary Examiner*—Joseph H. McGlynn
*Attorney, Agent, or Firm*—Sughrue, Mion, Zinn Macpeak & Seas

[57] ABSTRACT

A metal housing for an electrical connector such as a standardized HE12 connector comprises two half-housings enclosing a connector plug adapted to be inserted into a socket. Each half-housing comprises a half-hinge and an orifice having a contour which is open when the two half-housings are open to enable insertion of cables and which is closed when the two half-housings are closed. Fork-shape projections in each half-housing constitute two insulation-displacement contacts for establishing an electrical connection between the half-housing and the screening braid of each cable and to prevent the cable being pulled out. Tangs in each half-housing are inserted in insulation displacement contacts when the two half-housings are closed to constitute electrical screens preventing electromagnetic interference between nearby contacts. A captive screw constitutes both a rotation spindle for the hinge and means for fixing the housing to a nut fixed to the chassis. The housing protects the connector against electromagnetic interference.

8 Claims, 2 Drawing Sheets

METAL HOUSING FOR AN ELECTRICAL CONNECTOR

BACKGROUND OF THE INVENTION

1. Field of the Invention

The invention concerns a metal housing for an electrical connector particularly suitable for cables including a conductive braid covered with insulation, the braid surrounding at least one insulated electrical conductor and providing a screen against electromagnetic interference.

2. Description of the Prior Art

It is known to protect the end of the cable, when connected to a connector, by providing the connector with a metal housing. This is electrically connected to the braid and to a metal chassis carrying a socket into which the connector is inserted. It is also known to use a metal-coated plastics material housing which is lighter in weight and less costly than an entirely metal housing. To achieve good protection it is essential that the electrical contact resistance between the braid and the housing is extremely low.

French patent application 2 576 457 describes a metal housing for an electrical connector particularly suitable for a cable having a single braid surrounding a plurality of insulated electrical conductors. A length of the end portion of the braid is stripped and covers a first tube which is accommodated between the braid and the insulation covering the conductors. A second tube outside the braid covers its end portion. The second tube is made from copper, for example. It is crimped to fasten together the two tubes and the braid. The first tube is attached to the housing and the braid is therefore fixed firmly to the housing and the electrical contact resistance between the housing and the braid is very low.

A disadvantage of this type of housing is that fitting it requires a relatively large number of operations: one operation to strip the braid; one operation to fit the first tube between the braid and the insulation; one operation to fit the second tube around the braid; and a crimping operation. Also, this type of housing is not suitable for connecting a plurality of small cables each comprising an individual screening braid.

Other known types of housing include a rubber ring, or a spring ring, clamped by a sort of nut, to press the screening braid of a cable against a part of the metal housing, this part usually being conical in shape. Another known type of housing includes an orifice through which the cable is passed and having a plane part against which the cable is pressed by a collar. If the cable incorporates a screening braid the latter is stripped in line with the orifice of the housing to make electrical contact with the housing at the point where the collar clamps the cable against the housing. All these known housing types have the disadvantages of requiring the braid to be stripped and of incorporating bulky clamping means.

U.S. Pat. No. 4,533,199 describes a connector in the form of a single piece of plastics material comprising two generally plane parts articulated by a flexible hinge. A first part carries contacts each in the form of an insulation-displacement fork with the major axis perpendicular to the plane of the first part. The second part carries bosses. This connector can be used to connect a plurality of cables each comprising a screening braid and an insulated interior conductor. The cables are disposed in flat bundles and each is connected to two adjacent insulation-displacement forks. One fork makes contact with the braid through the insulation covering the braid and one fork makes contact with the interior conductor through the insulation covering this conductor, the braid and the exterior insulation being removed near the end of the cable.

The cables are pressed into the fork by closing the two articulated parts together, each cable being pressed into its fork by bosses on the second part of the connector. The connector is held closed after this operation by a latching device which is an integral part of the connector and comprises two lugs which snap into place in two apertures.

A particular advantage of this connector is that it is compact and can be used to connect a plurality of cables each comprising an individual screening braid. The connection to each braid does not require any stripping of the cable. On the other hand, this connector has the disadvantage of not providing any screening of the end of each cable. External interference can therefore affect the conductors through the plastics material. Also, interference may arise from radiation from the ends of adjacent cables, within the connector itself.

The object of the invention is to propose a compact housing which protects the ends of the cables against external and internal electromagnetic interference and which can be fitted without stripping the screening braids. The invention consists in a metal housing comprising two facing half-housings hinged together and incorporating orifices provided with projections in the form of forks constituting insulation-displacement contacts for electrically connecting the housing to the screening braid of each cable by the simple action of closing the two half-housings by rotation about the hinge axis.

SUMMARY OF THE INVENTION

In accordance with the invention, in a metal housing for an electrical connector comprising two facing metal half-housings and assembly means for enclosing a connector plug adapted to be inserted into a connector socket and to be connected to at least one cable comprising a conductive braid covered with insulation and surrounding at least one insulated electrical conductor projecting beyond the end of the braid, each half-housing comprises:

at least one orifice on the periphery of the half-housing and having an open contour when the two half-housings are open and a closed contour when they are closed, said closed contour having dimensions adapted to allow at least one cable to pass through it;

at least one fork-shape projection in said at least one orifice and constituting an insulation-displacement contact for establishing an electrical connection between the half-housing and the braid of a cable and for retaining the cable.

Good contact is established the braid of each cable and this protects the ends of the cables against electromagnetic interference from outside the housing. The projections constituting insulation-displacement contacts also retain the cables to prevent them being pulled out.

In one embodiment of the invention each half-housing comprises a half-hinge, the two half-hinges cooperating to form a hinge whereby the two half-housings can be opened or closed. This embodiment has the advantage that because of the hinge the two half-housings can be fastened together by a single screw. This reduces the number of parts in the connector assembly. This reduction in the number of parts simplifies fitting. In particular, in the case of manual fitting, it is easier to manipulate a housing which does not separate into two independent parts.

In one embodiment of the invention at least one half-housing comprises tangs adapted to form screens between contacts carried by the connector plug. The tangs bear against some contacts in the case of wire-wrap or soldered contacts or are inserted in some contacts in the case of insulation-displacement contacts as the two half-housings are closed. The tangs constitute electrical screens protecting some contacts against interference that may be caused by nearby contacts and the ends of the cables. These tangs also make it possible to connect the housing ground to some contacts of the plug in order to ground the socket contacts corresponding to these plug contacts.

In one embodiment of the invention an orifice on one half-housing is combined with an orifice on the other half-housing when the half-housings are closed to form a conduit which groups the cables into a flat bundle whose plane is orthogonal to the hinge rotation axis and the two half-housings each comprise a ramp-shape boss adapted to retain the flat bundle by reducing the width of the passage for the flat bundle between the two half-housings as the number of cables in the flat bundle diminishes along the connector plug. An advantage of this embodiment is that the cable access is in the form of a flat bundle parallel to the plane of a chassis supporting the connector socket into which the connector plug is inserted, which makes it possible to achieve a particularly compact implementation of the connector and the cables.

The invention will be better understood and other details will emerge from the description below and the accompanying figures:

DETAILED DESCRIPTION OF THE INVENTION

Figure 1:
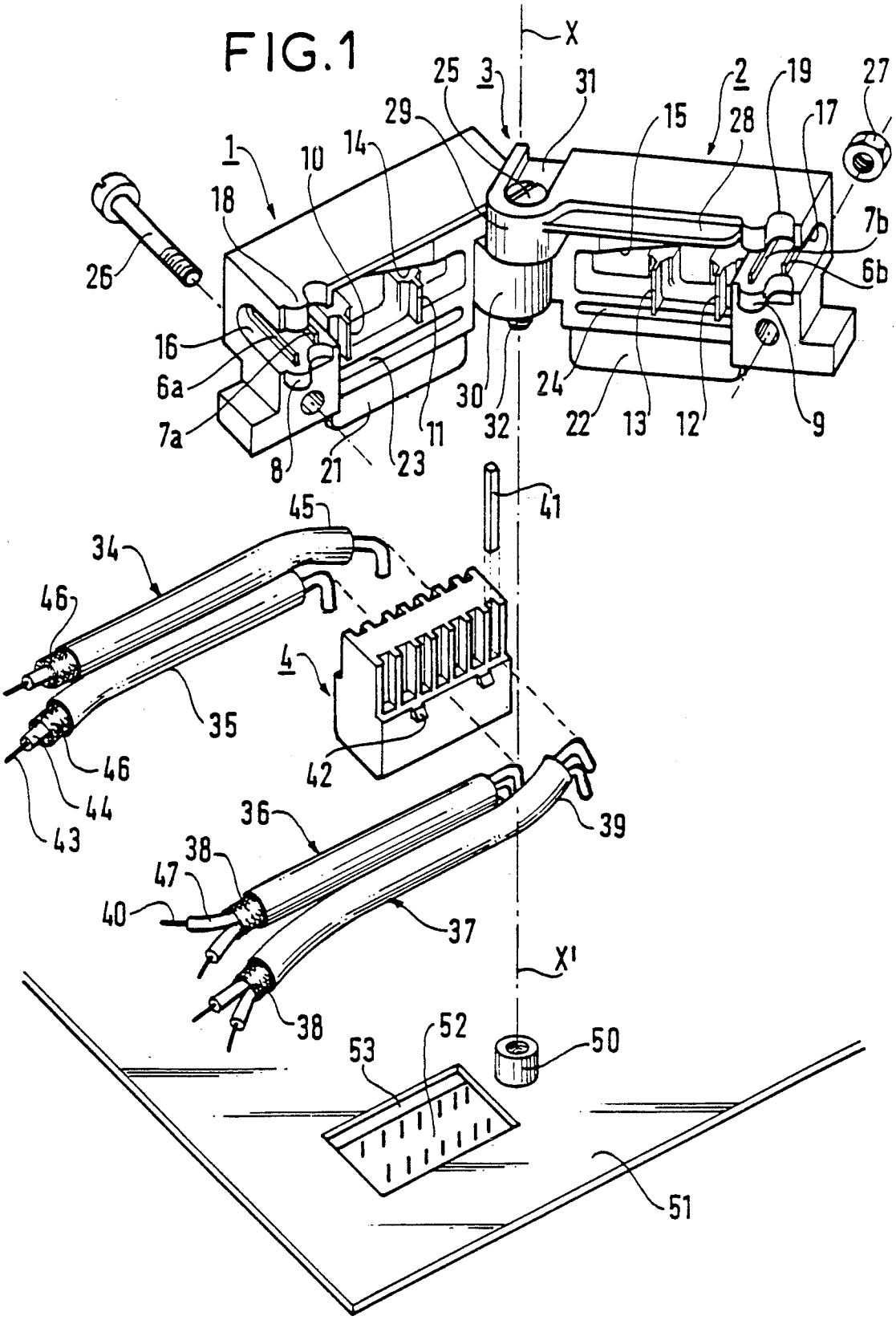
FIG. 1 shows a exploded view of one embodiment of the housing in accordance with the invention and its use with four cables each having an individual screening braid.

As shown in FIG. 1, this embodiment includes two half-housings 1 and 2 articulated together about a rotation axis XX' by a hinge 3 formed by a captive screw 25. The half-housings 1 and 2 incorporate respective half-hinges 29 and 30 which rotate about the screw 25. The axis of symmetry of the screw 25 constitutes the rotation axis XX'. The screw 25 also fixes the housing to a chassis 51. It is screwed into a nut 50 fixed to the chassis 51. The chassis 51 supports a connector socket 52. The socket 52 is fixed to the other side of the chassis 51 relative to the nut 50, the connector being inserted into the socket 52 through a rectangular aperture 53 slightly larger than the socket. Note that the rotation axis XX' is parallel to the direction in which the connector plug 4 is inserted into the socket 52.

Because of the hinge 3 the two half-housings 1 and 2 can be opened or closed. They can be clamped together when closed using a screw 26 and a nut 27. They then enclose a connector plug 4 formed by a block of plastics material incorporating compartments each accommodating a contact 41. The connector plug 4 incorporates four lugs 42, of which only two are visible in FIG. 1. The lugs snap into recesses 23 and 24 in the respective half-housings 1 and 2.

This embodiment is designed for an HE12 type connector plug as standardized in France and in Europe. It can include insulation-displacement, wire-wrap or soldered contacts. This example has two rows of contacts 41 which are connected to four cables 34 to 37 each including a screening braid. Of course, the invention is not limited to this connector plug or to this number of cables.

In this example, the cables 34 and 35 each comprise an outer insulative sheath 45, a screening braid 46, an intermediate insulative sheath 44 and a single interior conductor 43. The cables 36 and 37 each comprise an insulative sheath 39, a screening braid 38 and two conductors 40 each insulated by an intermediate insulative sheath 47'. Of course, the screening braids 38, 46 can be single braids or multiple braids formed by a plurality of concentric layers of braiding.

When the two half-housings 1 and 2 are closed they enclose the cables 34 through 37 in a conduit formed by an orifice 16 on the periphery of the half-housing 1 and an orifice 17 on the periphery of the half-housing 2. Each of these orifices has an open contour when the two half-housings are opened which enables the cables 34 and 35 to be inserted in the orifice 16 and the cables 36 and 37 to be inserted in the orifice 17. When the two half-housings are closed, these two contours form a single closed contour with an oblong shape and the exact dimensions for the four cables 34 through 37 to pass through, assembling the four cables into a flat bundle whose plane is parallel to the plane of the chassis 51 and orthogonal to the axis XX'.

The details of this embodiment are seen more clearly in FIGS. 2 through 6.

Figure 2:
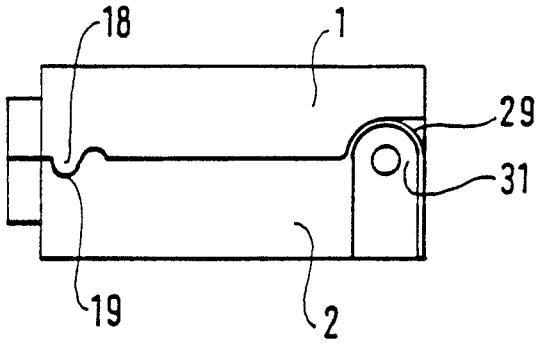
FIGS. 2 through 5 are respectively a plan view, a front view, a bottom view and a side view of this embodiment.

FIG. 2 shows a plan view of the housing with the two half-housings 1 and 2 closed. The hinge 3 is in two parts of which one is a rounded part 29 of the half-housing 2. The rounded part 29 includes a recess 31 to accommodate the head of the captive screw 25. FIG. 2 shows that the two half-housings meet at a joint surface incorporating an S-shape undulation in the vicinity of the orifices 16 and 17. A boss 18 on the half-housing 1 is inserted in a recess 19 on the half-housing 2. Likewise, a boss on the half-housing 2 is inserted in a recess on the half-housing 1. The function of this undulation will emerge later.

Figure 3:
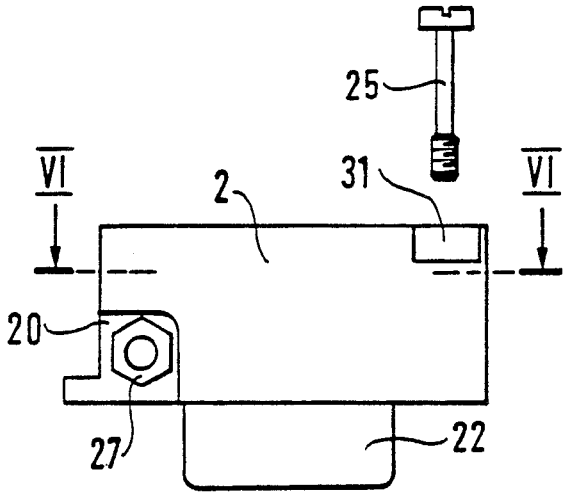

FIG. 3 is a front view showing the recess 31 accommodating the head of the captive screw 25, a recess 20 accommodating the nut 27 and a tang 22. The tang 22 on the half-housing 2 and a tang 21 on the half-housing 1 constitute a guide for inserting the plug 4 into the socket 52 and a screen along the longer sides of the socket.

Figure 4:
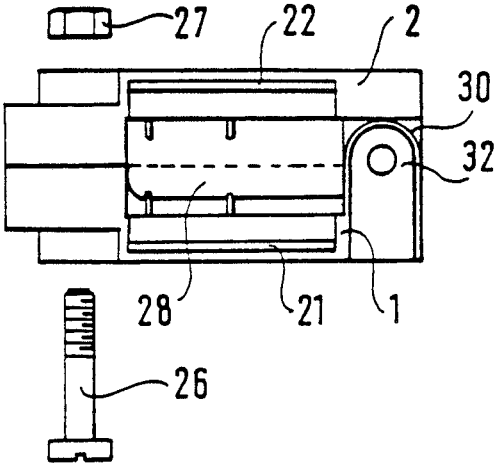

FIG. 4 is a bottom view of this embodiment and shows a second half of the hinge 3 formed by a rounded part 30 of the half-housing 1. The rounded part 30 includes a recess 32 accommodating the threaded part of the captive screw 25. The recess 32 enables the screw 25 to be retracted and indexing of the nut 50 when the connector is inserted into the socket 52. FIG. 4 shows the two tangs 21 and 22 and a tang 28 extending the rim of the half-housing 2 below the joint with the half-housing 1, in the upper part of the half-housing 2. The tang 28 covers the joint when the two half-housings are closed.

Figure 5:
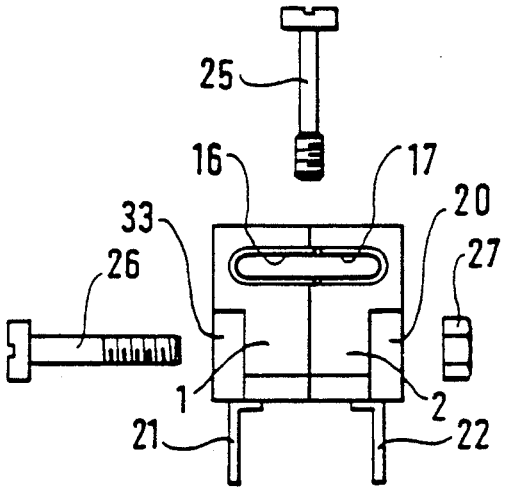

FIG. 5 is a side view showing how the orifices 16 and 17 meet to form a closed oblong orifice adapted to assemble four cables into a flat bundle whose plane is parallel to the chassis 51. It also shows the profile of the tangs 21 and 22, the recess 20 accommodating the nut 27 and a recess 33 similar to the recess 20 and adapted to accommodate the head of the screw 26.

Figure 6:
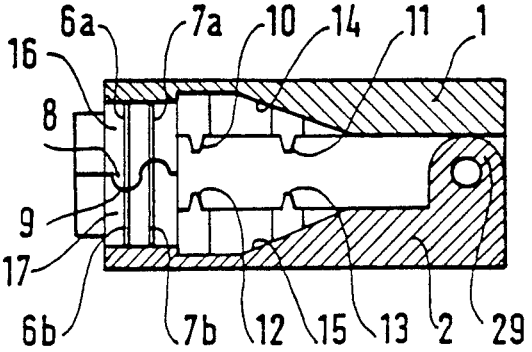
FIG. 6 shows this embodiment in cross-section.

FIG. 6 is a cross-section on a section plane VI showing interior features of the housing. It shows that at the orifice 16 half-housing 1 comprises two fork-shape projections 6*a* and 7*a*. Each constitutes an insulation-displacement contact integral with the half-housing 1, which cuts through the insulative layer 45 of the cables 34 and 35 when the two half-housings are closed and retains the cables 34 and 35 in the orifice 16.

At the orifice 17 half-housing 2 comprises two fork-shape projections 6*b* and 7i b integral with half-housing 2 and in line with the projections 6*a* and 7*a*. Each constitutes an insulation-displacement contact which cuts through the insulative layer 39 of the cables 36 and 37 when the two half-housings are closed and retains these cables in the orifice 17. The projections 6*a*, 6*b* and 7*a*, 7*b* electrically connect each braid to the housing at four contact points, for greater security, as will emerge later. Another function of these projections is to retain the cables to prevent them being pulled out.

FIG. 6 also shows that the lower part of the orifices 16 and 17 comprises an S-shape undulation similar to the undulation on the joint surface located in the upper part of these orifices. A boss 8 on the half-housing 1 is inserted in a recess 9 on the half-housing 2 and a boss on the half-housing 2 is inserted in a recess on the half-housing 1. The function of the undulations 8, 9, 18, 19 is to offset the discontinuity between the projection 6*a* and the projection 6*b* relative to the discontinuity between the projection 7*a* and the projection 7*b*. In this way any defective contact made with the braid of one cable because of the discontinuity of the projections 6*a* and 6*b* is compensated by a sound contact established by the projection 7*b*. In a similar way, the projection 6*a* compensates for the discontinuity of the projections 7*a* and 7*b*.

It is feasible for the joint surfaces adjacent the orifices 16 and 17 to be a different shape, so that the projections 6*a* and 7*a* are different lengths and the projections 6*b* and 7*b* are different lengths, to make the contacts more secure, as in the embodiment described.

FIG. 6 also shows that the thickness of the half-housing 1 varies. It is thinner near the orifice 16 and thicker near the hinge, to form a ramp-shape boss 14. This boss retains the flat bundle of cables by reducing the width of the passage for the flat bundle between the two half-housings as the number of cables in the flat bundle diminishes along the connector plug 4. As shown in FIG. 1, the major axis of the flat bundle of cables is parallel to the rows of contacts 41 and the number of cables in the flat bundle diminishes along the rows of contacts. The cable 35 is shorter than the cable 34, for example, with the result that the end of the cable 34 could be left loose if there were no boss 14 and the stiffness of the cable 34 could be sufficient to pull the contact 6 fixed to the end of the conductor 43 out of the connector plug 4.

In a similar way the half-housing 2 includes a boss 15 which guides the end of the cable 37 towards the connector plug 4.

FIG. 6 also shows that the half-housing 1 includes two tangs 10 and 11 parallel to the axis XX' and which, when the half-housings are closed, are inserted into respective insulation-displacement contacts of the connector plug 4 or bear against respective wire-wrap or soldered contacts of the plug 4, depending on the type of contact used in the plug. The tangs 10 and 11 constitute electrical screens to protect a group of contacts from electromagnetic interference radiated by nearby contacts. They additionally provide an electrical connection between the metal housing and contacts on the socket 52. In a similar way the half-housing 2 includes two tangs 12 and 13 which are inserted into respective insulation-displacement contacts carried by the connector plug 4 or bear against respective wire-wrap or soldered contacts of the plug 4, depending on the type of contact used in the plug.

To fit the connector, the ends of the four cables 34 through 37 are stripped of the exterior insulation 45, 39 and of the braid 46, 38 over the same length. In the case of an insulation-displacement contact connector, the conductors 40, 43 covered by the intermediate sheaths 47, 44 are inserted into the plug contacts using a conventional tool. In the case of a connector plug with wire-wrap or soldered contacts, the conductors 40, 43 are stripped of the intermediate sheaths 47, 44 before they are connected to the plug contacts using a conventional tool. The connector plug 4 and the cables 34 through 37 are then inserted into the housing, the housing is closed and the screw 26 is screwed into the nut 27.

When the two half-housings are closed, the following occur simultaneously: contact is established between the housing and the braid of each cable; contact is established between the housing and some contacts of the connector plug; a screen is inserted between some contacts of the connector plug. All these operations are achieved very simply because it is not necessary to strip the cables at the projections 6*a*, 6*b*, 7*a*, 7*b*. Note also that the implementation is particularly compact as the cables are grouped into a flat bundle in a plane parallel to the plane of the chassis 51.

The invention is not limited to the embodiment described above. Numerous variations thereon will suggest themselves to those skilled in the art. The housing can be manufactured by die casting a conventional light alloy. Simple injection molding tooling is sufficient, as removal from the mold can be achieved without any undercut.

There is claimed:

1. Metal housing for an electrical connector comprising two facing metal half-housings and assembly means for enclosing a connector plug adapted to be inserted into a connector socket and to be connected to at least one cable comprising a conductive braid covered with insulation and surrounding at least one insulated electrical conductor projecting beyond the end of the braid, wherein each half-housing comprises:

at least one orifice on the periphery of the half-housing and having an open contour when the two half-housings are open and a closed contour when they are closed, said closed contour having dimensions adapted to allow at least one cable to pass through it;

at least one fork-shape projection in said at least one orifice, said projection being integral with said half-housing and constituting an insulation-displacement contact for establishing an electrical connection between the half-housing and the braid of a cable and for retaining the cable.

2. Housing according to claim 1 for a connector plug including insulation-displacement contacts wherein to form screens between contacts carried by the connector plug at least one of said half-housings incorporates tangs which are inserted in respective insulation-displacement contacts carried by the connector plug when the two half-housings are closed.

3. Housing according to claim 1 for a connector plug including wire-wrap or soldered contacts wherein to constitute screens between contacts carried by the connector plug at least one of said half-housings includes tangs which bear against respective wire-wrap or soldered contacts carried by the connector plug when the two half-housings are closed.

4. Housing according to claim 1 for a connector adapted to be connected to a plurality of cables wherein an orifice on one half-housing is aligned with an orifice on the other half-housing when the half-housings are closed to form an elongated conduit which groups the cables into a flat bundle whose plane is orthogonal to the rotation axis of the hinge and the two half-housings each include a ramp-shape boss to retain the flat bundle by reducing the width of the passage for the flat bundle between the two half-housings as the number of cables in the flat bundle diminishes along the connector plug.

5. Housing according to claim 1 wherein the assembly means comprise a half-hinge on each half-housing, and means coupling the half-hinges of the two half-housings to form a hinge enabling the two half-housings to be opened or closed by rotation about a rotation axis through said hinge.

6. Housing according to claim 5 a connector adapted to be connected to a plurality of cables wherein an orifice on one half-housing is aligned with an orifice on the other half-housing when the half-housings are closed to form an elongated conduit which groups the cables into a flat bundle whose plane is orthogonal to the rotation axis of the hinge, each orifice includes at least two fork-shape projections to constitute at least two insulation-displacement contacts applied to the braid of the same cable and the joint surfaces of the two half-housings include undulations in the vicinity of 7. Housing accoding to claim 5 wherein the rotation axis is parallel to the direction in which the connector plug is inserted into the socket. the orifices, on either side thereof, so that the lengths of the projections situated in the same orifice are different from each other.

8. Housing according to claim 7 wherein the two half-hinges are coupled by a captive screw whose axis of symmetry is coincident with the rotation axis of the two half-housings and the captive screw engages a nut to fix the housing to a chassis supporting the socket.

* * * * *